US008077187B2

(12) United States Patent
Bezryadin et al.

(10) Patent No.: US 8,077,187 B2
(45) Date of Patent: Dec. 13, 2011

(54) IMAGE DISPLAY USING A COMPUTER SYSTEM, INCLUDING, BUT NOT LIMITED TO, DISPLAY OF A REFERENCE IMAGE FOR COMPARISON WITH A CURRENT IMAGE IN IMAGE EDITING

(75) Inventors: Sergey N. Bezryadin, San Francisco, CA (US); Maxim Y. Kuzovlev, Moscow (RU); Michael Shenker, Sunnyvale, CA (US)

(73) Assignee: KWE International, Inc., South San Francisco, CA (US)

( * ) Notice: Subject to any disclaimer, the term of this patent is extended or adjusted under 35 U.S.C. 154(b) by 0 days.

(21) Appl. No.: 12/757,315

(22) Filed: Apr. 9, 2010

(65) Prior Publication Data

US 2010/0194772 A1 Aug. 5, 2010

Related U.S. Application Data

(63) Continuation of application No. 11/613,678, filed on Dec. 20, 2006.

(51) Int. Cl.
*G09G 5/00* (2006.01)

(52) U.S. Cl. ..... 345/619

(58) Field of Classification Search ..... None
See application file for complete search history.

(56) References Cited

U.S. PATENT DOCUMENTS

| | | | |
|---|---|---|---|
| 5,485,568 | A | 1/1996 | Venable et al. |
| 5,825,941 | A | 10/1998 | Linford et al. |
| 6,088,018 | A | 7/2000 | DeLeeuw et al. |
| 6,353,450 | B1 | 3/2002 | DeLeeuw |
| 2002/0064302 | A1 | 5/2002 | Massengill |
| 2004/0029068 | A1 | 2/2004 | Sachdeva et al. |

OTHER PUBLICATIONS

C. Meng, M. Yasue, A. Imamiya, X. Mao, "Visualizing Histories for Selective Undo and Redo", Jul. 17, 1998, IEEE, Proceedings of Computer Human Interaction, 1998, pp. 459-464.*

Thomase Berlage, "A Selective Undo Mechanism for Graphical User Interfaces Based on Command Objects", Sep. 1994, ACM, Journal ACM Transactions on Computer-Human Interaction, vol. 1, Issue 3, pp. 269-274.* gluScaleImage, GLU http://www2llifl.fr/~aubert/opengl_ref/gluScaleImage.3G.html.

glDrawPixels, GL http://www2llifl.fr/~aubert/opengl_ref/glDrawPixels.3G.html.

Chapter 1. Introduction to Open GL—Open GL Reference Manual http://www.rush3d.com/reference/opengl-bluebook-1.0/ch01.html.

Canon EOS Digital Digital Photo Professional Instruction Manual, Canon, Inc. 2004.

* cited by examiner

*Primary Examiner* — Ulka Chauhan
*Assistant Examiner* — Robert Bader
(74) *Attorney, Agent, or Firm* — Haynes and Boone, LLP

(57) ABSTRACT

When editing an image (160.2) with a computer system, a command may be issued to display a reference image (160.0 or 160.1) to allow a human user to visually compare the current image (160.2) with the reference image. In response, some embodiments display the entire reference image in the position of the current image. In some embodiments, if the current image was rotated, trimmed, or otherwise modified in respect to its geometry, the reference image is also rotated, trimmed, and/or otherwise modified in respect to its geometry when displayed for comparison. If another image ("third image") (610) was incorporated into the current image during editing, then the reference image may or may not be combined with the third image when displayed for comparison with the current image. Some embodiments allow the user to specify whether or not the reference image should be combined with the third image.

37 Claims, 2 Drawing Sheets

IMAGE DISPLAY USING A COMPUTER SYSTEM, INCLUDING, BUT NOT LIMITED TO, DISPLAY OF A REFERENCE IMAGE FOR COMPARISON WITH A CURRENT IMAGE IN IMAGE EDITING

CROSS REFERENCE TO RELATED APPLICATIONS

The present application is a continuation of U.S. patent application Ser. No. 11/613,678 filed Dec. 20, 2006, incorporated herein by reference.

BACKGROUND OF THE INVENTION

The present invention relates to processing and display of images using a computer system.

An image obtained with a digital photographic camera can be edited using a computer system. A typical computer system includes a computer processor 110 (FIG. 1), a computer storage 120, and a user input device or devices 130 such as a keyboard and a mouse. Storage 120 stores digital data representing the image and also stores a computer program (with its software instructions and data) for image editing. The image is displayed on a computer monitor's screen 140, and edited by executing commands entered by a human user via input devices 130. The edited image ("current image") is shown at 160 in FIG. 1. Editing may include changing brightness, contrast, hue, and/or other color attributes of all or part of the image. Special commands may be provided to display the original image, shown at 160.0, to allow visual comparison of the current image 160 with the original image. In this operation, original image 160.0 can be displayed immediately above, below, or side by side with image 160. The special commands do not require the user to specify the absolute position of image 160.0 on screen 140. Rather, the user specifies the relative position (above, or below, etc.) of image 160.0 relative to the current image 160. Alternatively, the user may specify a split-image display (FIG. 2), with half of the original image 160.0 superimposed on the corresponding half of the current image 160. See "EOS DIGITAL, Digital Photo Professional, E, Windows, INSTRUCTION MANUAL", Canon Inc. 2004, page 2-40 and page 3-6.

SUMMARY

This section summarizes some features of the invention. Other features are described in the subsequent sections. The invention is defined by the appended claims which are incorporated into this section by reference.

The inventors have observed that it is sometimes easier to visually compare the two images if the entire original image 160.0 is displayed in the position of the current image 160, i.e. the entire image 160.0 is superimposed over the current image. Therefore, in some embodiments of the present invention, when the user enters a special command to compare the two images, the original image 160.0 is displayed in place of the current image, in the same position as the current image. In response to another command, the current image is redisplayed in the same position.

Visual image comparison is harder if the current image was rotated, trimmed, or otherwise modified in respect to its geometry. In some embodiments of the present invention, the original image is also rotated, trimmed, and/or otherwise modified in respect to its geometry when the original image is displayed for comparison. If another image ("third image") was incorporated into the current image during editing, then the original image may or may not be combined with the third image when the original image is displayed for comparison with the current image. Some embodiments allow the user to specify whether or not the original image should be combined with the third image.

Some embodiments allow the user to compare the current image with a reference image other than the original image, e.g. with a previous version obtained during editing.

The invention is not limited to the features and advantages described above. The invention is not limited to displaying the reference image for the purpose of comparison with the current image, as the invention can be applied to other purposes, known or to be invented. Other features of the invention are described below. The invention is defined by the appended claims.

DESCRIPTION OF SOME EMBODIMENTS

The embodiments described in this section illustrate but do not limit the invention. The invention is defined by the appended claims.

Figure 1:
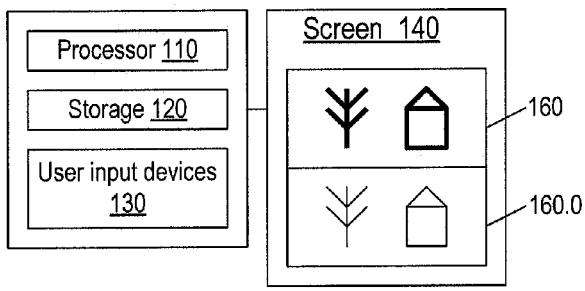
FIG. 1 PRIOR ART
FIG. 1 illustrates a computer system performing image editing according to prior art.
Figure 2:
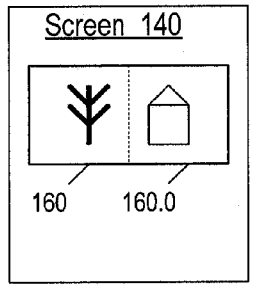
FIG. 2 PRIOR ART
FIG. 2 illustrates a computer monitor's screen in an image editing operation according to prior art.
Figure 3:
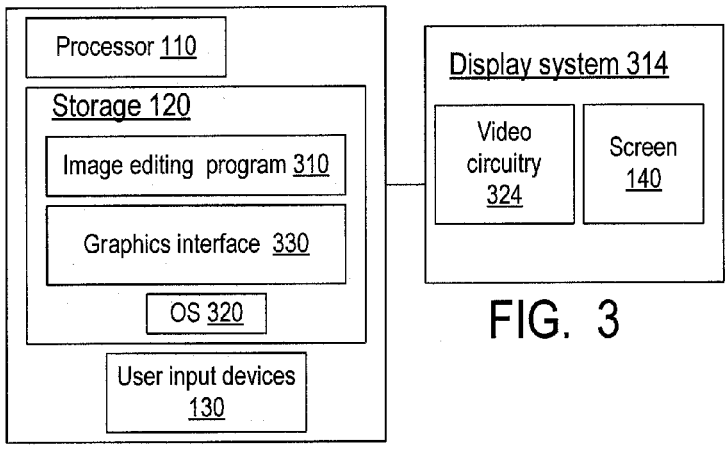
FIG. 3 illustrates an exemplary computer configuration for some embodiments of the present invention.

FIG. 3 illustrates a possible hardware/software configuration for image processing according to some embodiments of the present invention. Computer processor or processors 110, storage 120, and user input devices 130 can be as in FIG. 1 or some other type, known or to be invented. Storage 120 may include semiconductor, optical, magnetic, and/or possibly other types of computer storage. Storage 120 stores an image editing program (software program) 310 which communicates with a display system 314 directly or through an operating system 320 (such as Microsoft® Windows, UNIX®, or some other type). Display system 314 includes a computer monitor with screen 140, and may also include circuitry 324, possibly manufactured on a video card and possibly including computer processors and computer storage (for example, a frame buffer memory). Image editing program 310 communicates with OS 320 directly and/or via a graphics interface package 330 (for example, OpenGL® defined by Silicon Graphics® Incorporated, or DirectX® available from Microsoft® Corporation, or some other graphics interface, known or to be invented).

The invention is not limited to any particular software/hardware configuration. Graphics interface 330 may be implemented as a hardwired device, or may be absent. OS 320 and/or circuitry 324 may also be absent. Program 310 may be replaced with hardwired circuitry. The illustration of FIG. 3 is merely to explain that some embodiments of the invention may consist of software program 310 alone, or of program 310 combined with graphics interface 330 and/or OS 320 (both of which may or may not be prior art), or of other types and combinations of software instructions, data, and/or hard-wired components. Some embodiments of the invention consist of a computer readable medium (e.g. an optical disk) incorporating the program 310. Another embodiment may consist of a signal incorporating the program 310 and transmitted over a network, such as generated to download the program 310 from one computer into another computer. Another embodiment consists of a transmitting the program 310 over a computer network. Other embodiments are also possible.

Figure 4:
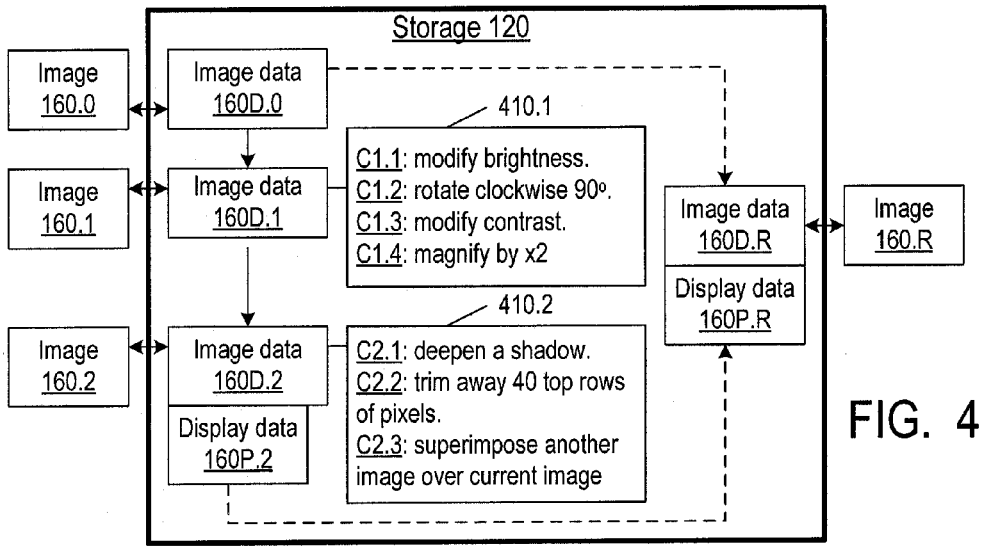
FIG. 4 illustrates data and commands for image editing according to some embodiments of the present invention.

FIG. 4 illustrates images and corresponding data in an image editing process using the computer system of FIG. 3 or some other suitable system. The original image 160.0 can be obtained with a photographic or movie camera, or constructed with a computer using computer graphics or some other technology, or obtained in some other way, known or to be invented. Image 160.0 can be two-dimensional or three-dimensional. Image 160.0 is represented by image data 160D.0 in storage 120. Data 160D.0 may specify the color of each pixel in a two-dimension pixel array, or the color of each vertex of each object in a three-dimensional scene, or may specify a combination of two-dimensional and three-dimensional images (e.g. a three-dimensional image with a two-dimensional texture). Also, data 160D.0 may represent the image procedurally (by specifying procedures to be performed to display the image), or represent the image in some other way, known or to be invented. Image data 160D.0 may be scene-referenced, display-referenced, or some other type of image representation. In the case of a two-dimensional pixel array, the pixels ("image-data pixels") may correspond one-to-one to the screen pixels of screen 140, or the image-data pixels may be independent of screen 140 or display system 314. The correspondence between the image-data pixels and the screen pixels may be established by other commands and/or data (e.g. display data, not shown, similar to data 160P.2 described below in connection with image 160.2). In some embodiments, the display data specify the image position on screen 140 and a magnification factor defining the size of each image-data pixel relative to the screen pixels. It is also possible for screen 140 to be a non-pixel screen. Also, the display data may specify the image position relative to a window. A window is a virtual display which may be displayed at different positions on screen 140 as specified by user commands or in some other way, and may be hidden and/or overlapped by other windows. The image displayed on screen 140 may also be affected by manual controls associated with screen 140, by the processing performed by circuitry 324, by ambient lighting, and/or other factors, known or to be invented.

Figure 5:
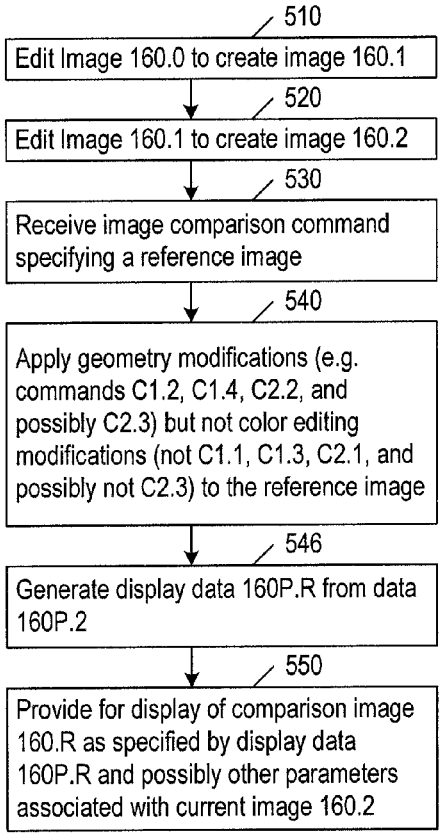
FIG. 5 is a flow chart of an image editing method according to some embodiments of the present invention.

Image 160.0 is edited in response to commands 410.1 to generate image data 160D.1 representing an edited image 160.1. See step 510 in the flowchart of FIG. 5. Image data 160D.1 may contain all the information defining the image 160.1, or may contain part of the information, the other part being provided by data 160D.0 or in some other way. In the example of FIG. 4, commands 410.1 are as follows:

C1.1: modify brightness of the image or an image portion.

C1.2: rotate the image clockwise by 90°.

C1.3: modify contrast of the image or an image portion.

C1.4: Magnify the image by a factor of 2.

Commands 410.1 are stored in storage 120 and are associated with image data 160D.1 (e.g. via pointers or other means, not shown). Data 160D.1 are also stored in storage 120. In some embodiments, the user issues a "Save" command to make a copy of image data 160D.1 and commands 410.1 in an area of storage 120. The copy will be available even if the image data 160D.1 are modified further to generate image data 160D.2 representing an image 160.2 as described below. The display data (similar to data 160P.2 as described above) may or may not be saved at this time. In some embodiments, the display data are only kept for the current image. In other embodiments, each saved image is saved with its displayed data.

Then the user issues additional commands 410.2. In response, the computer system edits the image 160.1 to create image data 160D.2 representing the image 160.2. See step 520 in FIG. 5. Image data 160D.2 may contain all the information defining the image 160.2, or may contain part of the information defining the image, the other part being provided by data 160D.1 and/or 160D.0 or in some other way. In the example of FIG. 4, commands 410.2 are as follows:

C2.1: deepen a shadow in the image.

C2.2: trim away (crop) 40 top rows of pixels (image-data pixels or screen pixels).

C2.3: superimpose another image over the current image.

Display data 160P.2 associated with image 160.2 specify the image position on screen 140 or in a virtual display such as a window. Display data 160P.2 may also specify a magnification factor and other magnification parameters (e.g. integer rounding of the number of screen pixels corresponding to a single image-data pixel). Alternatively, or in addition, display data 160P.2 may contain other types of information.

Figure 6A:
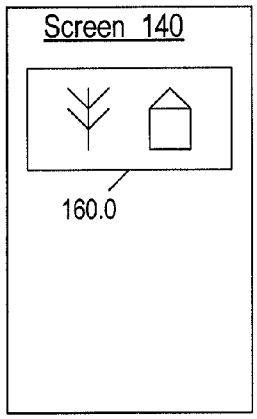
FIGS. 6A-6C illustrate exemplary images in the course of image editing according to some embodiments of the present invention.
Figure 6B:
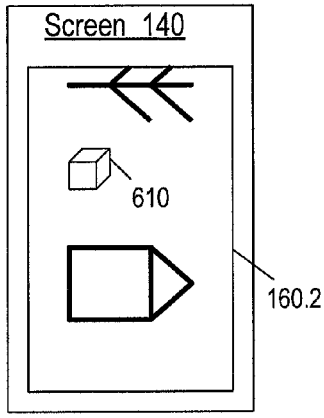

FIG. 6A illustrates an example of original image 160.0 on screen 140. FIG. 6B illustrates the edited image 160.2. The brightness has been changed by commands C1.1, C1.3, the image has been rotated by command C1.2 and magnified by a factor of 2 in response to command C1.4. Then the top was trimmed away (command C2.2), and another image 610 was superimposed (command C2.3).

Figure 6C:
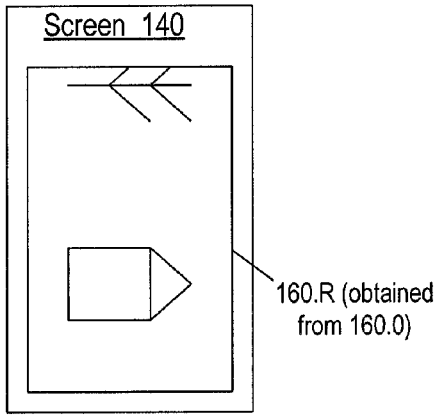

At step 530 (FIG. 5), the user enters a comparison command specifying the image 160.0 or 160.1 as a reference image. FIG. 6C shows the screen for the case of reference image 160.0. The comparison command can be entered with a key stroke, or by manipulating a graphical user interface, or in some other manner, known or to be invented. The command does not specify the absolute position of the reference image other than possibly by indicating the relative position of the reference image relative to the "current" image 160.2. In some embodiments, the relative position is specified via a setting defined by an earlier command (not shown), and the setting can be applied to each subsequent comparison command. In FIG. 6C, the relative position is the position of the current image, but another position (such as immediately below, immediately above, immediately to the left, or immediately to the right of the current image) can be specified instead.

Steps 540-550 illustrate operations performed by the computer system to execute the comparison command. These operations generate image data 160D.R (FIG. 4) representing image 160.R shown in FIG. 6C. These operations also generate display data 160P.R for displaying the image 160.R. More particularly, at step 540, the computer system reads the commands 410.1, 410.2, and selects the commands to be applied to the reference image 160.0 to generate the image 160.R. The selected commands are the type associated with geometry modifications such as rotation in the plane of the display (e.g. clockwise or counter-clockwise), flipping (i.e. rotation about a line located in the plane of the display), rotation about a point, re-sizing (magnification or shrinking), and trimming. In other embodiments, the selected commands also include composition with another image (e.g. image 610). Therefore, the computer system applies the commands C1.2, C1.4, C2.2 to image data 160D.0 to generate the image data 160D.R representing the image 160.R. (In other embodiments, the computer system also applies the command C2.3 to accomplish the composition with image 610 as described above.) Image data 160D.0 remain unchanged in storage 120. At step 546, the computer system generates display data 160P.R from display data 160P.2. If the image 160.R is to be displayed in the position of the current image 160.2 (as in FIG. 6C), then the display data 160P.R may be identical to data 160P.2. If the reference image is to be displayed in some other position, e.g. adjacent to the current image, the display data 160P.R are computed from the display data 160P.2 as appropriate. At step 550, the computer system arranges for displaying the image 160.R. For example, in the embodiment of FIG. 3, program 310 may issue a request to the display system 314 to display the image 160.R. In response, the display system 314 may display the image 160.R on screen 140 as shown in FIG. 6C, or may place the image into a window which may or may not be currently displayed on screen 140.

In some embodiments, whenever the user enters a Save command, the current image data 160D (such as 160D.1 or 160.2) and the corresponding command sequence 410 issued after the previous Save command (such as 410.2), if any, or after the editing process begin (as in the case 410.1) are saved in storage 120 as described above in connection with data 160D.1. Then a comparison command identifies either the original image 160.0 or a saved image (represented by saved data 160D) as a reference image. For example, in some embodiments, the computer system saves the image data 160D for each image in a file whose name incorporates a sequence number of the saved image (e.g. sequence number 1 for image 160.1, sequence number 2 for image 160.2, etc.). The original image 160.0 is associated with sequence number 0. When the user presses a key corresponding to a sequence number (e.g. key "1" for image 160.1), the computer system uses the corresponding image as a reference image. When the user releases the key, the current image is re-displayed. This user interface is exemplary and does not limit the invention.

Figure 7:
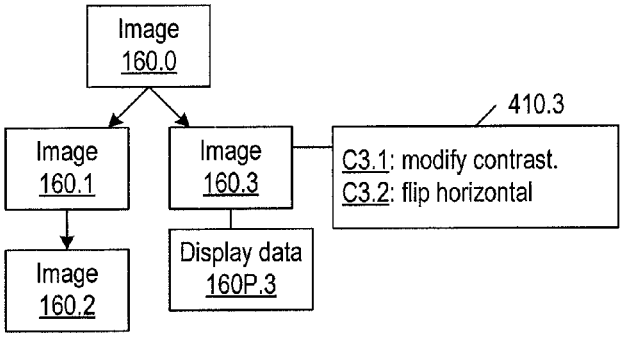
FIG. 7 illustrates a relationship between different images obtained in the course of image editing according to some embodiments of the present invention.

FIG. 7 illustrates an example of further editing. After performing the editing of FIG. 5 and re-displaying the image 160.2, the user saves the image 160.2, then edits the original image 160.0 with commands 410.3 to create an image 160.3. Commands 410.3 are as follows:

C3.1: contrast modification.

C3.2: flip horizontal, i.e. rotate about a vertical line lying in the image plane (e.g. the line passing through the center of the current image).

Then the user issues a comparison command (e.g. by pressing "2") specifying reference image 160.2. In response, the computer system determines the path from reference image 160.2 to current image 160.3 in the tree structure of images in FIG. 7. The path is: 160.2, 160.1, 160.0, 160.3. The computer system then applies reverse geometry modifications to image 160.2 to undo the geometry modifications in the command sets 410.2, 410.1 (in the reverse order), and applies geometry modifications of the commands 410.3. Thus, commuter system performs the following modifications:

C2.2$^{-1}$: add 40 rows of pixels, providing them with a predefined color or texture (e.g. hatching) to make it easy for the user to see the trimmed portion when the image 160.R is displayed. Alternatively, the 40 rows of pixels can be copied from the current image 160.3 or generated in any other way desired.

C1.4$^{-1}$: shrink the image by a factor of 2.

C1.2$^{-1}$: rotate counter-clockwise by 90°.

C3.2: flip horizontal.

In some embodiments, before the modification C2.2$^{-1}$, the following modification is also performed:

C2.3$^{-1}$: undo the command C2.3 by removing the image 610 from image 160.2. The portion occupied by image 610 can be filled with a predefined color or texture, or generated in some other way.

The resulting image 160.R is then displayed with the display data 160P.R obtained from the display data 160P.3 for the current image 160.3 as described above with respect to step 546.

In some embodiments, a single command may involve both modifications changing the image geometry (e.g. a rotation) and color modifications that do not change the image geometry. In such a case, only the modifications changing the image geometry are applied to the reference image.

Figure 8:
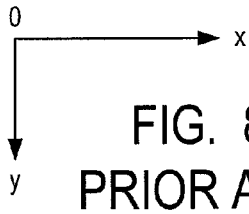
FIG. 8 PRIOR ART
FIG. 8 is a prior art coordinate system used in some embodiments of the present invention.

In some embodiments, the computer system combines multiple geometry modifications at step 540 into a single modification before applying them to the reference image. For example, rotations and re-sizing can each be represented by a square matrix. Then, assuming for example the left-hand coordinate system as in FIG. 8, clockwise rotation by 90° corresponds to the matrix $$\begin{bmatrix} 0 & -1 \\ 1 & 0 \end{bmatrix}$$

Clockwise rotation by 90° followed by stretching by a factor of k in the Y direction corresponds to the matrix $$\begin{bmatrix} 0 & -1 \\ k & 0 \end{bmatrix}$$

and so on. Different modifications can be combined using matrix multiplication, as known in linear algebra. For example, the commands C1.1, C1.4, represented by respective matrices $$\begin{bmatrix} 0 & -1 \\ 1 & 0 \end{bmatrix} \text{ and } \begin{bmatrix} 2 & 0 \\ 0 & 2 \end{bmatrix},$$

can be combined into a single matrix as follows:

$$\begin{bmatrix} 2 & 0 \\ 0 & 2 \end{bmatrix} \times \begin{bmatrix} 0 & -1 \\ 1 & 0 \end{bmatrix} = \begin{bmatrix} 0 & -2 \\ 2 & 0 \end{bmatrix}$$

A rotation can be represented by a matrix even though geometrically rotation may involve a shift, e.g. to place the upper left corner of the image into the upper left corner of screen 140 or a window. The shift may be omitted if it is always performed in some predefined way, e.g. to place the upper left corner of the image into the upper left corner of a window. Alternatively, a rotation may be defined as an affine transformation, e.g. using a matrix and a vector specifying the shift, or defined by the matrix and the window coordinates of the upper left corner of the image, or defined in some other way.

Of note, a reflection (flipping) about a line lying in the image plane, and a reflection or a rotation about a point lying in the image plane (e.g. about the center of the image) may also be represented in similar ways, e.g. as affine transformations, using matrices, with or without a vector specifying a shift. If the current image was rotated, flipped, and/or reflected so that it cannot be translated (shifted) in such a way as to correspond to the original image, the current image will be said to have a different orientation than the original image. If the current image was not rotated or reflected but was trimmed, then it can be translated in such a way that the elements (e.g. image-data pixels) of the current image can be superimposed over the corresponding elements of the original image. In this case, the two images will be said to have the same orientation. Similar terminology can be used for any two images obtained from the current image, e.g. images 160.2 and 160.3 in FIG. 7. If they cannot be superimposed one on top of the other by translation so that the corresponding elements match, then the two images will be said to have different orientations.

For three-dimensional images, rotations and reflections can be represented by 3×3 matrices or as three-dimensional affine transformations. If homogenous coordinates are used, such modifications can be represented by 4×4 matrices or as four-dimensional affine transformations. The invention is not limited to any representation of any modification.

Some embodiments of the present invention provide a computer-implemented method for image processing, the method comprising:

(1) providing a first image (e.g. the current image) to a computer display system;

(2) receiving a command to display a second image (e.g. a reference image), wherein the first image was obtained by editing the second image and/or the first and second images were obtained by editing a common image; and (3) in response to the command, processing the second image to obtain a processed image (e.g. image 160.R), and providing the processed image to the computer display system;

wherein:

(i) operation (3) comprises re-sizing the second image to obtain the processed image so that each element (e.g. each image-data pixel, or vertex, or some other element) of the processed image which corresponds to an element of the first image is displayed with the same size as the element of the first image; and/or (ii) the first and second images have different orientations, but the processed image has the same orientation as the first image; and/or (iii) the second image is processed to trim away a portion which corresponds to a portion trimmed away from the first image; and/or (iv) the second image is combined with a third image (e.g. 610) to obtain the processed image, wherein the third image is a component of the first image but not of the second image.

In some embodiments, only (i) holds true, or only (ii) holds true, and so on. Any combination of conditions (i)-(iv) may or may not hold true depending on the embodiment. In particular, in some embodiments, (iv) does not hold true. For example, there may be no image which is a component of the current image but not of the reference image, or there is such an image component but it is not incorporated into the reference image to obtain the processed image.

In some embodiments, the processed image is provided to the display system for display such that each element (e.g. each image-data pixel, or vertex, or some other element) of the processed image which corresponds to an element of the first image is to be displayed over the element of the first image.

Some embodiments provide a computer-implemented method for image processing, the method comprising:

obtaining digital data representing a first image (e.g. 160.0) and one or more second images, each second image incorporating zero or more modifications of the first image, each modification being either a first-type modification (e.g. a modification which does not incorporate an orientation change, trimming, and possibly composition with another image) or a second-type modification (e.g. a modification which incorporates orientation change, trimming, and possibly composition with another image);

receiving a display command (e.g. a comparison command) to display a reference image relative to a current image, wherein the reference image is one of the first and second images, and the current image is one of the one or more second images;

in response to the display command, processing the digital data to obtain a representation of a processed image (e.g. 160.R) incorporating the second-type modifications associated with the current image and either incorporating no first-type modifications (e.g. in the case of image 160.0 being the reference image) or incorporating the first-type modifications associated with the reference image.

Some embodiments provide a computer-implemented method for image processing, the method comprising:

obtaining digital data representing a first image and one or more second images;

providing a display position (e.g. with data 160P.2) of a current image to a display system, the current image being one of the one or more second images;

receiving a display command to display a reference image which is one of the first and second images and which is different from the current image;

using a position of the current image to determine a position in which the reference image is to be displayed; and providing data (e.g. 160P.R) to a display system for displaying the reference image such that each element of the reference image which corresponds to an element of the current image is displayed in the position of the element of the current image in accordance with the position determined for the reference image using the position of the current image.

The display position may be incorporated into data 160D, i.e. data 160P.R may be absent.

The invention is not limited to the embodiments described above. For example, commands do not have to be entered via input devices 130, but may be read from computer storage or a network. The term "command" may denote a sequence of commands entered at different times, including commands that establishes settings to be applied to subsequent commands. The invention is not limited to displaying the reference image for the purpose of comparison with the current image, and can be applied to other purposes, known or to be invented. Other embodiments and variations are within the scope of the invention, as defined by the appended claims.

The invention claimed is:

1. A computer-implemented method for image processing, the method comprising:

(1) providing, by a computer system, a first image to a computer display system, the first image being a 2D image defined by digital data defining pixel colors of a two-dimensional pixel array;

(2) receiving, by the computer system, a display command to display a second image which is a 2D image defined by digital data defining pixel colors of a two-dimensional pixel array, wherein the first image was obtained by editing the second image and/or the first and second images were obtained by editing a common image which is a 2D image defined by digital data defining pixel colors of a two-dimensional pixel array, wherein editing of each image comprises editing digital data representing the image in response to one or more editing commands; and (3) in response to the display command, processing, by the computer system, the second image to obtain a processed image defined by digital data defining pixel colors of a two-dimensional pixel array, and providing the processed image to the computer display system;

(4) wherein the processing comprises:

(4A) the computer system using one or more predefined types of operations to select, from the editing commands, each editing command involving any one of the one or more predefined types of operations;

wherein the one or more predefined types of operations do not include at least one type of color modification in an image on which the operation is to be performed;

(4B) the computer system deriving the processed image from each selected editing command but not from any deselected editing command, and from the digital data representing the second image;

wherein at least one of the following statements (i), (ii), (iii) (iv) is true:

(i) the one or more predefined types of operations include any type that modifies the size of at least one element of an image on which the operation is to be performed without removing the element from the image; and operation (3) comprises re-sizing the second image to obtain the processed image so that each element of the processed image which corresponds to an element of the first image is displayed with the same size as the element of the first image; and/or (ii) the one or more predefined types of operations include any type that modifies the orientation of an image on which the operation is to be performed; and the first and second images have different orientations, but the processed image has the same orientation as the first image; and/or (iii) the one or more predefined types of operations include any type that trims away a portion of an image on which the operation is to be performed; and the second image is processed to trim away a portion which corresponds to a portion trimmed away from the first image; and/or (iv) the one or more predefined types of operations include at least one type that combines an image on which the operation is to be performed with another image; and the second image is combined with a third image to obtain the processed image, wherein the third image is a component of the first image but not of the second image, the third image being introduced into the first image using said at least one type that combines an image with another image.

2. The method of claim 1 wherein (i) holds true.

3. The method of claim 1 wherein (ii) holds true.

4. The method of claim 1 wherein (iii) holds true.

5. The method of claim 1 wherein (iv) does not hold true as the second image is not combined with the third image which is a component of the first image.

6. The method of claim 1 wherein (iv) does not hold true as the first image does not have a component which is not a component of the second image.

7. The method of claim 1 wherein the processed image is provided to the computer display system for display in the position of the first image.

8. The method of claim 1 wherein the processed image is provided to the display system for display such that each element of the processed image which corresponds to an element of the first image is to be displayed over the element of the first image.

9. The method of claim 1 wherein the processed image is provided to the computer display system for display such that at least one element of the processed image is to be displayed with a color different from a color of the corresponding element of the first image.

10. The method of claim 1 wherein each of the first, second, common, and processed images is re-sizable by the computer system.

11. The method of claim 1 wherein the second image is a digital color photograph.

12. A computer system adapted to perform the method of claim 1, the computer system comprising:

one or more user input devices for a human user to provide the display command to the computer system for processing; and a system for performing said processing of the display command.

13. A non-transitory computer readable medium comprising one or more computer-readable computer instructions for causing a computer system to perform the method of claim 1.

14. A network transmission method comprising transmitting over a network a computer program for performing the method of claim 1.

15. An apparatus adapted to perform the method of claim 9, the apparatus comprising:

one or more user input devices for a human user to provide the display command to the computer system for processing;

a system for performing said processing of the display command; and the computer display system.

16. A non-transitory computer readable medium comprising one or more computer-readable computer instructions for causing a computer system to perform the method of claim 9.

17. A network transmission method comprising transmitting over a network a computer program for performing the method of claim 9.

18. A computer-implemented method for image processing, each image being represented by digital data, the method comprising:

(1) obtaining, by a computer system, first-image data which are digital data representing a first image;

(2) the computer system receiving editing commands, and editing the first image in response to the editing commands, wherein editing of each image comprises editing the digital data representing the image, and the first image is edited to obtain one or more second images from the first image, each second image being represented by associated digital data defined by the first-image data and the editing commands, each second image being associated with those one or more of the editing commands which were executed to obtain the second image from the first image;

(3) after obtaining the first and second images, the computer system receiving a display command via a human-user interface to display a reference image relative to a current image, wherein the reference image is one of the first and second images, and the current image is one of the one or more second images, the reference image being different in size and/or orientation from the current image, the display command identifying the reference image but not a size and orientation with which the second image is to be displayed;

(4) in response to the display command:

(4A) the computer system using one or more predefined types of operations to select, from the editing commands, each editing command involving any one of the one or more predefined types of operations, wherein the one or more predefined types of operations include any type that modifies the size of at least one element of an image on which the operation is to be performed without removing the element from the image, wherein the one or more predefined types include any type that modifies the orientation of the image on which the operation is to be performed, wherein the one or more predefined types of operations do not include at least one type of color modification in the image on which the operation is to be performed, the computer system deriving, from each selected editing command but not from any deselected editing command, and from the data representing one or more of the first and second images, a processed image which is to be displayed in response to the display command; and (4B) the computer system displaying the processed image.

19. The method of claim 18 wherein the one or more predefined types of operations do not include any color modification in the image on which the operation is to be performed.

20. The method of claim 18 wherein the reference image is the first image, and deriving the processed image comprises the computer system executing the one or more selected editing commands on the digital data representing the reference image.

21. The method of claim 18 wherein the reference image is a second image, and deriving the processed image comprises:

the computer system reversing geometry modifications performed in response to one or more of the selected editing commands used to obtain the reference image from the first image; and then the computer system executing one or more of the selected editing commands on digital data obtained from said reversing geometry modifications.

22. The method of claim 18 wherein the first and second images are each a 2D image, with the corresponding digital data defining a color of each pixel in a two-dimensional pixel array.

23. The method of claim 18 wherein each of the first and second images is re-sizable by the computer system.

24. A computer system adapted to perform the method of claim 18, the computer system comprising:

one or more devices for providing the editing commands and the display command to the computer system; and a system for editing the first image and performing the operation (4) in response to the display command.

25. A non-transitory computer readable medium comprising one or more computer-readable computer instructions for causing a computer system to perform the method of claim 18.

26. A network transmission method comprising transmitting over a network a computer program for performing the method of claim 18.

27. A computer system adapted to perform the method of claim 19, the computer system comprising:

one or more devices for providing the editing commands and the display command to the computer system; and a system for editing the first image and performing the operation (4) in response to the display command.

28. A non-transitory computer readable medium comprising one or more computer-readable computer instructions for causing a computer system to perform the method of claim 19.

29. A network transmission method comprising transmitting over a network a computer program for performing the method of claim 19.

30. A non-transitory computer-readable medium comprising one or more computer-readable computer instructions for causing a computer system to perform a method for image processing, the method comprising:

(1) providing, by the computer system, a first image to a computer display system, the first image being defined by digital data;

(2) receiving, by the computer system, a display command to display a second image which is defined by digital data, wherein the first image was obtained by editing the second image and/or the first and second images were obtained by editing a common image which is defined by digital data, wherein editing of each image comprises editing digital data representing the image in response to one or more editing commands; and (3) in response to the display command, processing, by the computer system, the second image to obtain a processed image defined by digital data, and providing the processed image to the computer display system;

(4) wherein the processing comprises:

(4A) the computer system determining if the editing commands comprise any command involving any one of one or more predefined types of operations;

wherein the one or more predefined types of operations do not include at least one type of color modification in an image on which the operation is to be performed;

(4B) if the editing commands comprise any command involving any predefined type of operations, the computer system deriving the processed image from each editing command involving any predefined type of operations but not from any other editing command, and from the digital data representing the second image;

wherein at least one of the following statements (i), (ii), (iii) (iv) is true:

(i) the one or more predefined types of operations include any type that modifies the size of at least one element of an image on which the operation is to be performed without removing the element from the image; and if at least one element of the processed image which corresponds to an element of the first image is different in size than the corresponding element of the first image, then operation (3) comprises re-sizing the second image to obtain the processed image so that each element of the processed image which corresponds to an element of the first image is displayed with the same size as the element of the first image; and/or (ii) the one or more predefined types of operations include any type that modifies the orientation of an image on which the operation is to be performed; and if the first and second images have different orientations, then the processed image has the same orientation as the first image; and/or (iii) the one or more predefined types of operations include at least one type that trims away a portion of an image on which the operation is to be performed; and if a portion was trimmed away from the first image in execution of one or more commands of said type that trims away a portion, then the second image is processed to trim away a portion which corresponds to the portion trimmed away from the first image; and/or (iv) the one or more predefined types of operations include at least one type that combines an image on which the operation is to be performed with another image; and if the first image was created using an operation of said type that combines an image with another image, which operation involved combining with a third image, then the second image is processed to perform combining with the third image to obtain the processed image.

31. The non-transitory computer-readable medium of claim 30 wherein (i) holds true.

32. The non-transitory computer-readable medium of claim 30 wherein (ii) holds true.

33. The non-transitory computer-readable medium of claim 30 wherein (iii) holds true.

34. The non-transitory computer-readable medium of claim 30 wherein (iv) does not hold true as the second image is not combined with the third image.

35. The non-transitory computer-readable medium of claim 30 wherein the processed image is provided to the display system for display such that each element of the processed image which corresponds to an element of the first image is to be displayed over the element of the first image.

36. The non-transitory computer-readable medium of claim 30 wherein the second image is a digital color photograph.

37. The method of claim 18 wherein the reference image is a second image, and deriving the processed image comprises:

the computer system reversing each operation of the one or more predefined types which was involved in each selected editing command used to obtain the reference image from the first image, said reversing of each operation providing a third image represented by associated digital data; and then the computer system executing, on the third image instead of the first image, each operation of the one or more predefined types which was performed in response to each selected editing command used to obtain the current image from the first image.

* * * * *